US010217400B2

(12) United States Patent
Staudenmaier et al.

(10) Patent No.: US 10,217,400 B2
(45) Date of Patent: Feb. 26, 2019

(54) DISPLAY CONTROL APPARATUS AND METHOD OF CONFIGURING AN INTERFACE BANDWIDTH FOR IMAGE DATA FLOW

(71) Applicant: Freescale Semiconductor, Inc., Austin, TX (US)

(72) Inventors: Michael Andreas Staudenmaier, Munich (DE); Vincent Aubineau, Areches (FR); Kshitij Bajaj, Sirsa (IN)

(73) Assignee: NXP USA, Inc., Austin, TX (US)

( * ) Notice: Subject to any disclaimer, the term of this patent is extended or adjusted under 35 U.S.C. 154(b) by 415 days.

(21) Appl. No.: 14/989,021

(22) Filed: Jan. 6, 2016

(65) Prior Publication Data

US 2017/0039932 A1 Feb. 9, 2017

(30) Foreign Application Priority Data

Aug. 6, 2015 (WO) ..... PCT/IB2015/001566

(51) Int. Cl.
*G09G 3/20* (2006.01)

(52) U.S. Cl.
CPC ..... *G09G 3/2096* (2013.01); *G09G 2320/041* (2013.01); *G09G 2370/08* (2013.01)

(58) Field of Classification Search
None
See application file for complete search history.

(56) References Cited

U.S. PATENT DOCUMENTS 6,154,225 A * 11/2000 Kou ..... G06F 3/1438 345/213
8,078,896 B2 12/2011 Karlsson
8,304,698 B1 11/2012 Tischler
2008/0252647 A1* 10/2008 Rai ..... G09G 5/395 345/520
2011/0001748 A1* 1/2011 Rutman ..... G09G 3/344 345/214

(Continued)

FOREIGN PATENT DOCUMENTS

WO 2011087522 A1 7/2011

OTHER PUBLICATIONS

A Comprehensive Approach to DRAM Power Management Ibrahim Hur and Calvin Lin High Performance Computer Architecture, 2008. HPCA 2008. IEEE 14th International Symposium on.

(Continued)

*Primary Examiner* — David D Davis

(57) ABSTRACT

A display control apparatus comprising at least one memory element within which image data is stored, at least one display controller arranged to read from the, or each, memory element the image data and to output display data generated from the read image data to at least one display device. The display control apparatus further comprises at least one interface component via which the display controller is arranged to read image data from the memory element. The display control apparatus further comprises at least one interface bandwidth control component arranged to measure image data flow over the interface component from the memory element to the display controller, and configure a bandwidth for image data flow over the interface component from the memory element to the display controller based at least partly on the measured image data flow.

17 Claims, 3 Drawing Sheets

(56) References Cited

U.S. PATENT DOCUMENTS

2014/0253537 A1* 9/2014 Lee ..... G09G 5/12
345/214

OTHER PUBLICATIONS

Mini-Rank: Adaptive DRAM Architecture for Improving Memory Power Efficiency Hongzhong Zheng et al Microarchitecture, 2008. Micro-41. 2008 41st IEEE/ACM International Symposium on.

* cited by examiner

DISPLAY CONTROL APPARATUS AND METHOD OF CONFIGURING AN INTERFACE BANDWIDTH FOR IMAGE DATA FLOW

FIELD OF THE INVENTION

This invention relates to a display control apparatus and a method of dynamically configuring a bandwidth for image data flow over an interface component from a memory element, within which image data is stored, to a display controller.

BACKGROUND OF THE INVENTION

In many embedded applications, power consumption and heat generation are critical design considerations. In applications such as automotive applications, embedded devices include, for example, display controllers for infotainment and instrument cluster displays. It is known for such embedded display controllers to read (fetch) image data to be displayed on-the-fly from external memory elements. For example, the display controller periodically reads image data from a memory element, potentially performs operations like blending, format conversions in a streaming processing mode, etc. and transmits the data to be displayed to the display. In this manner, the display controllers do not require internal memory within which to store image data to be displayed, thereby enabling a significant size and cost reduction of the display controllers. In order to avoid under-run of image data from the external memory elements to the display controllers, it is necessary to ensure sufficient bandwidth is provided between the external memory elements and the display controllers. However, the higher the bandwidth of the interface between the external memory element and the embedded display controller, the higher the power consumption and heat generation associated with such an interface. Accordingly, there is a trade-off between achieving low power consumption and heat generation whilst ensuring sufficient bandwidth between the external memory element and the embedded display controller.

SUMMARY OF THE INVENTION

The present invention provides a display control apparatus, an interface bandwidth control component and a method of dynamically configuring a bandwidth for image data flow over at least one interface component as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

In accordance with examples of the present invention, an interface bandwidth for image data flow from a memory element to a display controller is configured based on a measured image data flow. Advantageously, by configuring the interface bandwidth based on measured image data flow, a sufficient bandwidth for avoiding under-run of image data from the memory element to the display controller is dynamically configured. This avoids the use of a fixed, conservatively large bandwidth that would result in excessive and unnecessary power consumption and heat generation within the interface component.

Figure 1:
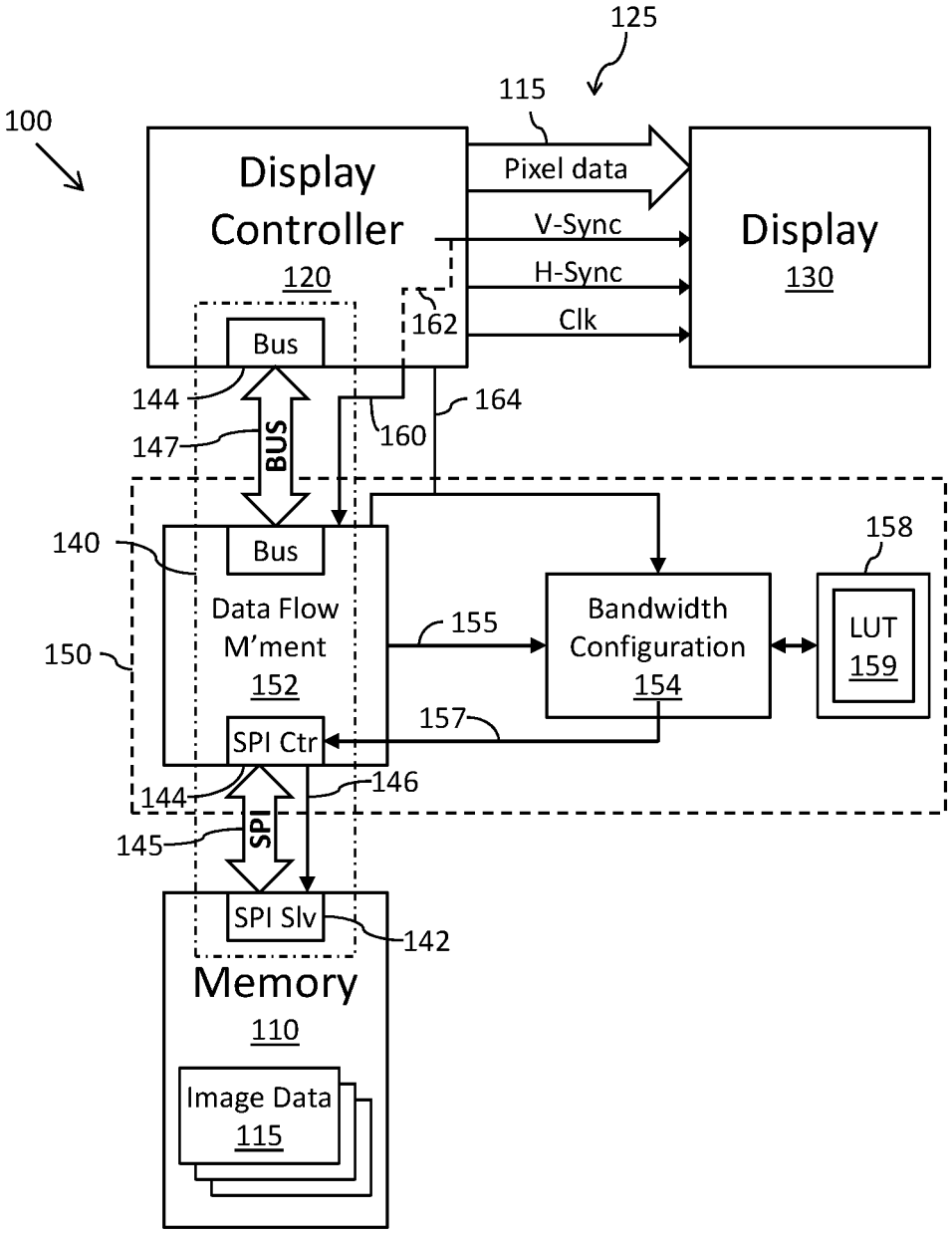
FIG. 1 illustrates a simplified block diagram of an example of a display control apparatus.

Referring now to FIG. 1, there is illustrated a simplified block diagram of an example of a display control apparatus 100, for example an embedded automotive display apparatus, adapted in accordance with the present invention. The display control apparatus 100 is coupled to one or more memory element(s) 110 within which image data 115 is stored. The memory element(s) may consist of external memory elements located on a different semiconductor die to that of the display control apparatus 110, or may consist of 'internal' memory element(s) located on the same semiconductor die to that of the display control apparatus 110. The image data 115 may be in the form of, for example, raw pixel data such as, for example, RGBA (Red, Green, Blue and Alpha) pixel data, and typically represents graphical objects (e.g. layers) that may be combined or otherwise used in combination to generate frames to be displayed. The display control apparatus 100 includes one or more display controller(s) 120 arranged to read image data 115 to be displayed from the memory element(s) 110 and to output display data 125 to one or more display device(s) 130 to cause the display device(s) 130 to display a frame generated from the read image data 115. For simplicity and ease of understanding, the display control apparatus 100 will hereinafter be described with reference to just a single memory element 110, a single display controller 120 and a single display 130, as illustrated in FIG. 1.

The instantaneous display data 125 output by the display controller 120 typically includes pixel data 115 for one pixel, for example a 32-bit value made up of four 8-bit bytes defining the red, green, blue and alpha components of the pixel respectively. The display data 125 further includes a clock (Clk) signal delineating when pixel data 115 for consecutive pixels to be displayed is being output by the display controller 120. Thus, for each clock cycle of the display data 125, the display controller 120 outputs the pixel data 115 for one pixel to the display 130, e.g. 32-bits of pixel data 115. The display data 125 further includes a vertical synchronisation (V-Sync) signal indicating when the pixel data 115 being output by the display controller 120 corresponds to a first pixel of a new frame to be displayed, and a horizontal synchronisation (H-Sync) signal indicating when the current pixel data 115 being output by the display controller 120 corresponds to a first pixel of the next line in the frame to be displayed.

The display control apparatus 100 further includes at least one interface component, indicated generally at 140 in FIG.

1 by the broken lines, via which the display controller 120 is arranged to read image data 115 from the memory element(s) 110. For simplicity and ease of understanding, the display control apparatus 100 will hereinafter be described with reference to just a single interface component 140, as illustrated in FIG. 1.

In the illustrated example, the interface component 140 consists of a serial peripheral interface (SPI). As is well known in the art, an SPI is a synchronous serial communication interface typically used for short distance communication within embedded systems. For example, an SPI controller 142 within (or coupled to) the memory element 110 serially (i.e. one bit at a time) transmits image (e.g. pixel) data 115 over an SPI bus 145 to an SPI controller 144 within (or coupled to) the display controller 120. In some examples, the interface component 140 may consist of a quad SPI (QSPI) interface that transmits data four bits at a time.

In order to avoid under-run of pixel data 115 from the memory element 110 to the display controller 120, it is necessary to ensure sufficient bandwidth is provided across the interface component 140. Conventionally, in order to avoid under-run of pixel data 115 from the memory element 110 to the display controller 120, the interface component 140 would be configured to have a fixed bandwidth (data rate) sufficient for an anticipated maximum data flow across the interface component 140 from the memory element 110 to the display controller 120.

In the example illustrated in FIG. 1, the display control apparatus 100 includes an interface bandwidth control component 150. The interface bandwidth control component 150 is arranged to measure image data flow across the interface component 140 from the memory element 110 to the display controller 120, and to configure a bandwidth for image data flow across the interface component 140 from the memory element 110 to the display controller 120 based at least partly on the measured image data flow. In particular for the illustrated example, the interface bandwidth control component 150 includes a data flow measurement component 152 located within the image data path between the memory element 110 and the display controller 120, and arranged to measure image data flow across the interface component 140 from the memory element 110 to the display controller 120, and to output an indication 155 of the measured image data flow. For example, the data flow measurement component 152 may be arranged to count the number of transferred bytes for a defined timeslot.

For the illustrated example in which the interface component 140 consists of an SPI bus 145, the memory element 110 acts as a slave device, and as such includes an SPI bus slave module 142. In the example illustrated in FIG. 1, the data flow measurement component 152 is arranged to act as the master SPI device, and as such includes a bus master module 144. A simple internal bus structure, illustrated generally at 147, may be provided between the data flow measurement component 152 and the display controller 120. In this manner, when the display controller 120 is to read image data 115 from the memory element 110, it sends a request for the image data 115 over the internal bus structure 147. The data flow measurement component 152 then forwards the request received from the display controller 120 to the memory element 110 via the SPI bus 145. Upon receipt of the requested image data 115, the data flow measurement component 152 forwards the received image data 115 on to the display controller 120, via the internal bus structure 147, and measures the number of bytes of image data forwarded to the display controller 120.

In some examples, the data flow measurement component 152 is arranged to measure image data flow across the interface component 140 over a period of time, and to output an indication 155 of a peak flow of image data 115 measured across the interface component 140 during that period of time. For example, the data flow measurement component 152 may be arranged to repeatedly measure the number of bytes transmitted across the interface component 140 during intervals of a defined duration. The data flow measurement component 152 may then output an indication 155 of the maximum number of measured bytes transmitted during a single interval of the defined duration. Such an indication 155 of the peak flow may simply be a single bit value indicating whether, for example, the maximum number of measured bytes transmitted across the interface component 140 during a single interval of the defined duration exceeded a threshold value. Conversely, such an indication 155 of the peak flow may be a multi-bit value providing a finer granularity indication of the peak flow to be output by the data flow measurement component 152.

In the example illustrated in FIG. 1, the data flow measurement component 152 is arranged to receive a start of frame indication 160 from the display controller 120, and to measure image data flow between consecutive start of frame indications 160. In some examples, the start of frame indication 160 is provided by the vertical synchronisation (V-Sync) signal of the display data 125, as indicated by the broken line 162 in FIG. 1. In this manner, the data flow measurement component 152 illustrated in FIG. 1 is arranged to measure image data flow across the interface component 140 over the period of time between two consecutive start of frame indications (i.e. a period equal to that for displaying a single frame of data), and to output an indication 155 of a peak value for the image data flow measured over a plurality of intervals of a predefined duration between the two consecutive start of frame indications.

In some examples, the data flow measurement component 152 may be arranged to continuously measure image data flow across the interface component 140, and output an indication 155 of the peak measured data flow for each consecutive period of time (e.g. for consecutive start of frame time periods in the illustrated example). Alternatively, and as illustrated in FIG. 1, the data flow measurement component 152 may be arranged to receive a display update signal 164 from the display controller 120 indicating when the display controller 120 has been updated, for example to display an additional graphics layer, resize a graphics layer, read image data 115 from a different memory element 110, etc. Upon receipt of such a display update signal 164, the data flow measurement component 152 may be arranged to output/update the indication 155 of the peak measured data flow.

It is contemplated that the indication 155 of the measured data flow is not limited to providing an indication of a peak flow of image data 115 measured across the interface component 140 during a period of time. For example, the indication 155 of the measured data flow may alternatively provide an indication of, for example, total data flow during a period of time, an average data flow during a defined of time, etc.

The interface bandwidth control component 150 illustrated in FIG. 1 further includes a bandwidth configuration component 154 arranged to receive the indication of the measured image data flow 155 output by the data flow measurement component 152, and to configure the bandwidth for image data flow across the interface component 140 from the memory element 110 to the display controller 120 based at least partly on the received indication of the measured image data flow 155. For example, the bandwidth configuration component 154 may be arranged to lookup a bandwidth to be configured for image data flow over the interface component 140 from a lookup table (LUT) 158, stored within a memory element coupled to the bandwidth configuration component 154, using the received indication of the measured image data flow 155. Alternatively, the bandwidth configuration component 154 may be arranged to calculate a bandwidth to be configured for image data flow over the interface component 140 based on inputting the received indication of the measured image data flow 155 into an algorithm.

The bandwidth configuration component 154 may configure the bandwidth for image data flow over the interface component 140 from the memory element 110 to the display controller 120 in any suitable manner. For example, the bandwidth configuration component 154 may be arranged to output a bandwidth configuration signal 157 indicating a desired bandwidth for image data flow over the interface component 140. As illustrated in FIG. 1, the bandwidth configuration signal 157 may be provided to the SPI bus master module 144 within (or coupled to) the data flow measurement component 152. Typically, requests and the clock signal 146 for an SPI bus are generated by the bus master. Accordingly, the SPI bus master module 144 within (or coupled to) the data flow measurement component 152 may be arranged to configure the SPI clock signal 146 corresponding to the desired bandwidth indicated by the bandwidth configuration signal 157. Alternatively, the bandwidth configuration component 154 may be arranged to directly configure a source clock signal (not shown) from which the SPI clock signal 146 is generated.

Furthermore, it is contemplated that the bandwidth configuration component 154 is not limited to configuring the bandwidth for image data flow over the interface component 140 solely through configuring a data rate (i.e. clock signal) with which image data 115 is transmitted over the interface component 140. For example, the interface component 140 may consist of multiple SPI buses 145, and the bandwidth configuration component 154 may additionally/alternatively be arranged to configure the number of SPI buses used to transmit image data 115 from the memory element 110 to the display controller 120. For example, when a high bandwidth is required for transmitting image data 115 from the memory element 110 to the display controller 120, the bandwidth configuration component 154 may be arranged to enable one or more 'auxiliary' SPI bus(es) 145 to provide additional bandwidth. Conversely, when a low bandwidth is required for transmitting image data 115 from the memory element 110 to the display controller 120, the bandwidth configuration component 154 may be arranged to disable the auxiliary SPI bus(es) 145 to reduce power consumption and heat generation.

Additionally, it is contemplated that for examples where the interface component 140 consists of a bus/interface consisting of multiple data lines for transmitting multiple bits of data at a time, such as a quad SPI (QSPI) interface that transmits data four bits at a time, the bandwidth configuration component 154 may additionally/alternatively be arranged to configure the number of data lines used by such a bus/interface to transmit image data 115 from the memory element 110 to the display controller 120.

In some examples, and as illustrated in FIG. 1, the bandwidth configuration component 154 may be arranged to receive the display update signal 164 indicating when the display controller 120 has been updated. Upon receipt of an indication that the display controller 120 has been updated, the bandwidth configuration component 154 may initially configure a maximum bandwidth for image data flow over the interface component 140 from the memory element 110 to the display controller 120. In this manner, sufficient bandwidth for transmission of the image data 115 for the new (updated) frame may be assured. The bandwidth configuration component 154 may then wait for the data flow measurement component 152 to measure image data flow over the interface component 140 from the memory element 110 to the display controller 120 for the updated frame image, and subsequently re-configure the bandwidth for image data flow over the interface component 140 from the memory element 110 to the display controller 120 based on the measured image data flow for the updated frame image data.

Advantageously, by configuring the bandwidth for data flow over the interface component 140 based on measured image data flow, a sufficient bandwidth for avoiding underrun of image data 115 from the memory element 110 to the display controller 120 may be dynamically configured, whilst reducing the power consumption and heat generation resulting from the transmission of image data 115 from the memory element 110 to the display controller 120. In particular, as the data rate for image data being displayed changes, for example due to changes in the layers to be combined to generate the image to be displayed, the bandwidth of the interface component 140 can be dynamically adapted accordingly.

In the example illustrated in FIG. 1, a serial peripheral interface (SPI) is provided for accessing image data 115 stored within the memory element 110. However, it is contemplated that other types of data communication structures or mechanisms may equally be implemented in place of such an SPI. For example it is contemplated that substantially any serial or parallel interface mechanism that enables the bandwidth for the transmission of data there across to be adapted, for example through frequency scaling or the number or width of interface components to be adapted, may equally be implemented. Examples of such alternative interface mechanisms include, but are not limited to:

- SDR/DDR (single data rate/double data rate) interfaces;
- Parallel address/data busses used either on-chip or to connect to external memory devices such as Flash memory, RAM (random access memory) memory, etc; and
- PCI Express (Peripheral Component Interconnect Express) interfaces.

In the example illustrated in FIG. 1, the data flow measurement component 152 and the bandwidth configuration component 154 of the interface bandwidth control component 150 have been illustrated and hereinbefore described as standalone components discrete from the display controller and the memory element 110. For example, the data flow measurement component 152 form an integral part of the interface component 140 and the bandwidth configuration component 154 may be implemented by way of, for example, software executing on a processing core, or by way of a dedicated hardware component.

Figure 2:
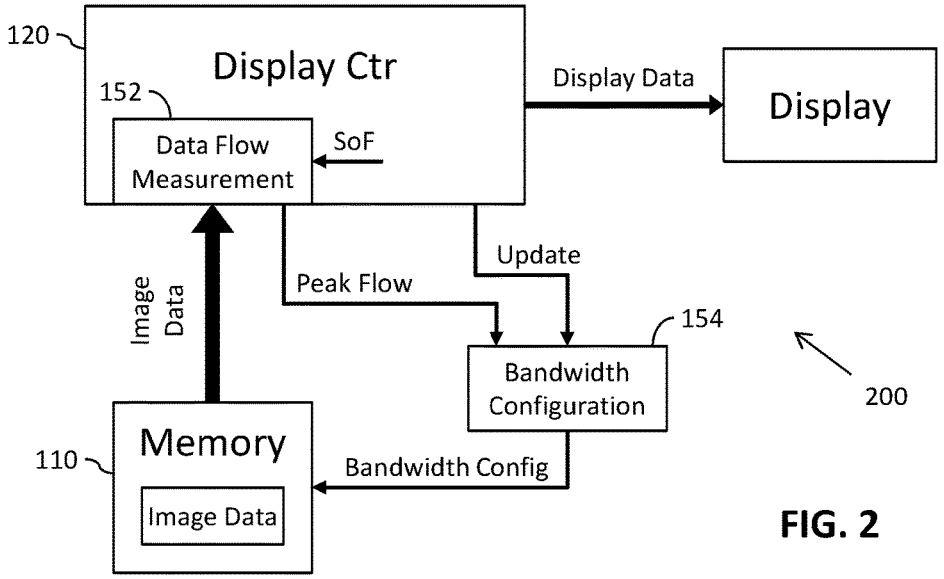
FIG. 2 illustrates a simplified block diagram of an alternative example of a display control apparatus.

FIG. 2 illustrates a simplified block diagram of an alternative example of a display control apparatus 200. In the example illustrated in FIG. 2, the data flow measurement component 152 is integrated within the display controller 120.

Figure 3:
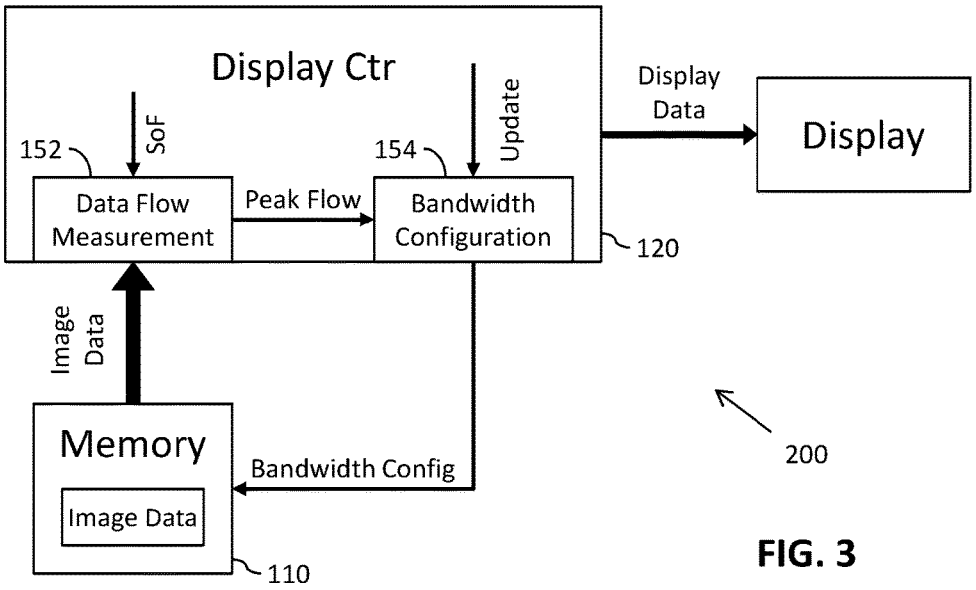
FIG. 3 illustrates a simplified block diagram of a further alternative example of a display control apparatus.

FIG. 3 illustrates a simplified block diagram of a further alternative example of a display control apparatus 300. In the example illustrated in FIG. 2, the bandwidth configuration component 154 is also integrated within the display controller 120.

It will be appreciated that further alternative implementations other than those illustrated in the accompanying drawings are contemplated. For example, the data flow measurement component 152 or the bandwidth configuration component 154 may be integrated within the memory element 110. Furthermore, although the data flow measurement component 152 and the bandwidth configuration component 154 have been illustrated and hereinbefore described as separate functional components, it is contemplated that the respective functionality may be implemented within a single hardware component.

Figure 4:
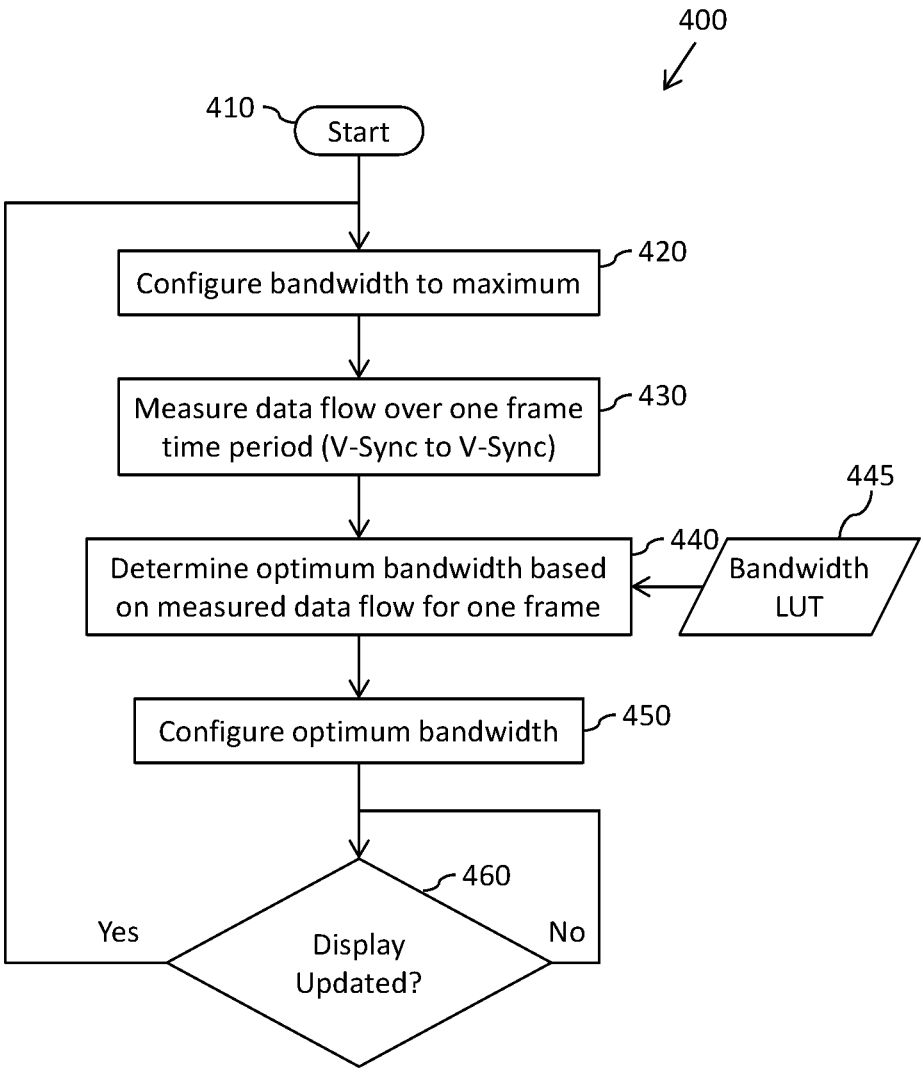
FIG. 4 illustrates a simplified flowchart of an example of a method of dynamically configuring a bandwidth for image data flow over an interface component from one or more memory elements to one or more display controllers.

Referring now to FIG. 4, there is illustrated a simplified flowchart 400 of an example of a method of dynamically configuring a bandwidth for image data flow over an interface component from one or more memory elements to one or more display controllers, such as may be implemented by the bandwidth configuration components 154 illustrated in FIGS. 1 to 3. The method starts at 410, and moves on to 420 where a maximum bandwidth for image data flow over the interface component from the memory element(s) to the display controller(s) is configured. Next, at 430, image data flow over the interface component from the memory element(s) to the display controller(s) is measured. An optimum bandwidth for image data flow over the interface component from the memory element(s) to the display controller(s) is determined at 440 based on the measured data flow for, in the illustrated example, one frame being displayed. For example, and as illustrated in FIG. 4, the optimum bandwidth for image data flow may be obtained from a lookup table 445. Alternatively, the optimum bandwidth for image data flow may be determined by inputting the measured image data flow into an algorithm. It is contemplated that such an optimum bandwidth consists of a bandwidth that ensures a sufficient data rate to avoid underrun of image data from the memory element(s) to the display controller(s), whilst minimizing the power consumption and heat generation of the interface component. Having determined the optimum bandwidth for image data flow over the interface component from the memory element(s) to the display controller(s), the interface component is configured to have a bandwidth for image data flow from the memory element(s) to the display controller(s) in accordance with the determined optimum bandwidth, at 450. Subsequently, upon receipt of an indication that the display data for the frame being displayed has been updated, for example to display an additional graphics layer, resize a graphics layer, read image data 115 from a different memory element 110, etc., the method loops back to 420 where a maximum bandwidth for image data flow over the interface component from the memory element(s) to the display controller(s) is configured, and the method repeats.

At least some parts the invention may be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on a tangible and non-transitory computer readable storage medium or transmitted to the computer system via a computer readable transmission medium. All or some of the computer program may be provided on computer readable media permanently, removably or remotely coupled to an information processing system. The tangible and non-transitory computer readable media may include, for example and without limitation, any number of the following: magnetic storage media including disk and tape storage media; optical storage media such as compact disk media (e.g., CD-ROM, CD-R, etc.) and digital video disk storage media; non-volatile memory storage media including semiconductor-based memory units such as FLASH memory, EEPROM, EPROM, ROM; ferromagnetic digital memories; MRAM; volatile storage media including registers, buffers or caches, main memory, RAM, etc.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

In the foregoing specification, the invention has been described with reference to specific examples of embodiments of the invention. Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

It will, however, be evident that various modifications and changes may be made therein without departing from the scope of the invention as set forth in the appended claims and that the claims are not limited to the specific examples described above.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Furthermore, the terms 'assert' or 'set' and 'negate' (or 'de-assert' or 'clear') are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. For example and as previously mentioned, although the data flow measurement component 152 and the bandwidth configuration component 154 have been illustrated and hereinbefore described as separate functional components, it is contemplated that the respective functionality may be implemented within a single hardware component.

Any arrangement of components to achieve the same functionality is effectively 'associated' such that the desired functionality is achieved. Hence, any two components herein combined to achieve a particular functionality can be seen as 'associated with' each other such that the desired functionality is achieved, irrespective of architectures or intermediary components. Likewise, any two components so associated can also be viewed as being 'operably connected,' or 'operably coupled,' to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. For example, the data flow measurement component 152 and the bandwidth configuration component 154 may be implemented as circuitry located on a single integrated circuit or within a same device. Alternatively, the examples may be implemented as any number of separate integrated circuits or separate devices interconnected with each other in a suitable manner. For example, the data flow measurement component 152 and the bandwidth configuration component 154 may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms 'a' or 'an,' as used herein, are defined as one or more than one. Also, the use of introductory phrases such as 'at least one' and 'one or more' in the claims should not be construed to imply that the introduction of another claim element by the indefinite articles 'a' or 'an' limits any particular claim containing such introduced claim element to inventions containing only one such element, even when the same claim includes the introductory phrases 'one or more' or 'at least one' and indefinite articles such as 'a' or 'an.' The same holds true for the use of definite articles. Unless stated otherwise, terms such as 'first' and 'second' are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

We claim:

1. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, configure a bandwidth of the interface component for image data flow over the interface component from the memory element to the display controller based at least partly on the measured image data flow, measure image data flow over the interface component, by measuring image data flow during a period of time comprising a duration corresponding to that for displaying a frame of data, and configure the bandwidth for image data flow over the interface component from the memory element to the display controller based at least partly on the image data flow measured over said period of time.

2. The display control apparatus of claim 1, wherein the interface bandwidth control component is arranged to receive a start of frame indication from the display controller, and to measure image data flow between at least two consecutive start of frame indications.

3. The display control apparatus of claim 1, wherein the interface bandwidth control component is arranged to receive a display update signal from the display controller indicating when display data for a frame being displayed is updated, and upon receipt of an indication that the display data for the frame being displayed has been updated, to reconfigure a bandwidth for image data flow over the interface component based at least partly on measured image data flow for an updated frame of data.

4. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, configure a bandwidth of the interface component for image data flow over the interface component from the memory element to the display controller based at least partly on the measured image data flow, receive a display update signal from the display controller indicating when display data for a frame being displayed is refreshed, and upon receipt of an indication that the display data for the frame being displayed has been refreshed to:

configure a maximum bandwidth for image data flow over the interface component from the memory element to the display controller, measure image data flow over the interface component from the memory element to the display controller, and re-configure the bandwidth for image data flow over the interface component from the memory element to the display controller based at least partly on the measured image data flow.

5. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, configure a bandwidth of the interface component for image data flow over the interface component from the memory element to the display controller based at least partly on the measured image data flow, and lookup a bandwidth to be configured for image data flow over the interface component from a lookup table, stored within a memory element coupled to the bandwidth configuration component, using the measured image data flow.

6. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, configure a bandwidth of the interface component for image data flow over the interface component from the memory element to the display controller based at least partly on the measured image data flow, and calculate a bandwidth to be configured for image data flow over the interface component based on inputting the measured image data flow into an algorithm.

7. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, and configure a bandwidth of the interface component for image data flow over the interface component from the memory element to the display controller based at least partly on the measured image data flow, wherein the interface bandwidth control component comprises a data flow measurement component located within the image data path between the memory element and the display controller and arranged to measure image data flow over the interface component from the memory element to the display controller.

8. A display control apparatus comprising:

a display controller coupled to a memory element within which image data is stored, the display controller being arranged to read from the memory element the image data and to output display data generated from the read image data to a display device;

an interface component, coupled to the memory element and the display controller, via which the display controller is arranged to read image data from the memory element; and an interface bandwidth control component, coupled to the interface component, and arranged to:

measure image data flow over the interface component from the memory element to the display controller, and configure a bandwidth of the interface component for image data flow over the interface component from the memory element to the display controller based at least partly on the measured image data flow, wherein the interface bandwidth control component comprises a bandwidth configuration component arranged to receive an indication of the measured image data flow, and to configure the bandwidth for image data flow over the interface component from the memory element to the display controller based at least partly on the received indication of the measured image data flow.

9. An interface bandwidth control component, coupled to an interface component via which a display controller is arranged to read image data from a memory element; the interface bandwidth control component is arranged to:

measure image data flow over the interface component from the memory element to the display controller;

configure a bandwidth of the interface component for image data flow over the interface component from the memory element to the display controller based at least partly on the measured image data flow;

measure image data flow over the interface component, by measuring image data flow during a period of time comprising a duration corresponding to that for displaying a frame of data; and configure the bandwidth for image data flow over the interface component from the memory element to the display controller based at least partly on the image data flow measured over said period of time.

10. The interface bandwidth control component of claim 9 further arranged to receive a start of frame indication from the display controller, and to measure image data flow between at least two consecutive start of frame indications.

11. The interface bandwidth control component of claim 9 further arranged to receive a display update signal from the display controller indicating when display data for a frame being displayed is updated, and upon receipt of an indication that the display data for the frame being displayed has been updated to reconfigure a bandwidth for image data flow over the interface component based at least partly on measured image data flow for an updated frame of data.

12. An interface bandwidth control component, coupled to an interface component via which a display controller is arranged to read image data from a memory element; the interface bandwidth control component is arranged to:

measure image data flow over the interface component from the memory element to the display controller;

configure a bandwidth of the interface component for image data flow over the interface component from the memory element to the display controller based at least partly on the measured image data flow;

receive a display update signal from the display controller indicating when display data for a frame being displayed is refreshed; and upon receipt of an indication that the display data for the frame being displayed has been refreshed:

configure a maximum bandwidth for image data flow over the interface component from the memory element to the display controller, measure image data flow over the interface component from the memory element to the display controller, and re-configure the bandwidth for image data flow over the interface component from the memory element to the display controller based at least partly on the measured image data flow.

13. An interface bandwidth control component, coupled to an interface component via which a display controller is arranged to read image data from a memory element; the interface bandwidth control component is arranged to:

measure image data flow over the interface component from the memory element to the display controller;

configure a bandwidth of the interface component for image data flow over the interface component from the memory element to the display controller based at least partly on the measured image data flow; and lookup a bandwidth to be configured for image data flow over the interface component from a lookup table, stored within a memory element coupled to the bandwidth configuration component, using the measured image data flow.

14. An interface bandwidth control component, coupled to an interface component via which a display controller is arranged to read image data from a memory element; the interface bandwidth control component is arranged to:

measure image data flow over the interface component from the memory element to the display controller;

configure a bandwidth of the interface component for image data flow over the interface component from the memory element to the display controller based at least partly on the measured image data flow; and calculate a bandwidth to be configured for image data flow over the interface component based on inputting the measured image data flow into an algorithm.

15. A method of dynamically configuring a bandwidth for image data flow over an interface component from a memory element within which image data is stored to a display controller arranged to read from the memory element the image data; the method comprising:

measuring image data flow over the interface component from the memory element to the display controller;

configuring a bandwidth for image data flow over the interface component from the memory element to the display controller based at least partly on the measured image data flow;

receiving a start of frame indication from the display controller; and measuring image data flow between at least two consecutive start of frame indications.

16. The method of claim 15 further comprising:

receiving a display update signal indicating when display data for a frame being displayed is updated; and upon receipt of an indication that the display data for the frame being displayed has been updated, re-configuring a bandwidth for image data flow over the interface component based at least partly on measured image data flow for an updated frame of data.

17. The method of claim 16 further comprising, upon receipt of an indication that the display data for the frame being displayed has been refreshed:

configuring a maximum bandwidth for image data flow over the interface component from the memory element to the display controller;

measuring image data flow over the interface component from the memory element to the display controller; and re-configuring the bandwidth for image data flow over the interface component from the memory element to the display controller based at least partly on the measured image data flow.

* * * * *